United States Patent [19]

Pariani

[11] 4,156,590

[45] May 29, 1979

[54] COMBUSTION IN A MELTING FURNACE

[75] Inventor: Ronald L. Pariani, Carrollton, Ga.

[73] Assignee: Southwire Company, Carrollton, Ga.

[21] Appl. No.: 867,854

[22] Filed: Jan. 9, 1978

Related U.S. Application Data

[62] Division of Ser. No. 770,495, Feb. 22, 1977.

[51] Int. Cl.[2] ..... F23D 11/38

[52] U.S. Cl. ..... 431/3; 431/123; 431/158; 431/353; 239/110

[58] Field of Search ..... 431/3, 123, 122, 158, 431/353; 239/110

[56] References Cited

U.S. PATENT DOCUMENTS

| | | | |
|---|---|---|---|
| 760,560 | 5/1904 | Perillat | 431/123 |
| 910,178 | 1/1909 | Cosmovici | 239/110 |
| 1,253,794 | 1/1918 | Deem | 239/110 |
| 1,421,031 | 6/1922 | Schmitt | 431/123 |
| 2,572,338 | 10/1951 | Hartwig et al. | 431/158 |
| 2,614,619 | 10/1952 | Fuller | 431/158 |
| 2,652,890 | 9/1953 | Morck, Jr. et al. | 431/158 |
| 3,547,568 | 12/1970 | Shisler | 431/158 |

FOREIGN PATENT DOCUMENTS

| | | | |
|---|---|---|---|
| 354304 | 8/1931 | United Kingdom | 239/397.5 |
| 807011 | 1/1959 | United Kingdom | 239/397.5 |

*Primary Examiner*—Carroll B. Dority, Jr.
*Assistant Examiner*—William R. Henderson
*Attorney, Agent, or Firm*—Herbert M. Hanegan; Stanley L. Tate; Robert S. Linne

[57] ABSTRACT

An improved premix gas burner design suitable for use in a metal melting furnace which has long service life, a low degree of maintenance, is easily cleared in case of burner blockage, allows inspection of the combustion chamber or furnace interior and still maintains the desired turndown capabilities of premix gas burners. These results are achieved by providing usual and/or physical access to the interior of the burner through a novel access tunnel and by providing a dual composition refractory combustion chamber.

5 Claims, 1 Drawing Figure

COMBUSTION IN A MELTING FURNACE

CROSS-REFERENCE TO RELATED APPLICATIONS

This application is a division of copending application Ser. No. 770,495 filed Feb. 22, 1977.

BACKGROUND OF THE INVENTION

This invention relates to an improvement to a combustion burner structure and more particularly to a premix gas burner assembly for use in a metal melting furnace, and which has feed orifice penetrating inspection and cleaning means.

Modern industrial heating processes and especially metal melting furnaces require burners which have a number of characteristics which have heretofore been compromised. It would be advantageous to improve, without detriment to some, all of the following characteristics:

1. easy clearing of the combustion chamber exit in the event of burner blockage by metal from the furnace,
2. dependable and safe flame ignition and supervision,
3. flame stability without excess and erratic noise,
4. efficient and complete combustion of the air/fuel mixture within the combustion chamber,
5. components which do not overheat, deform, or become damaged during extended periods of operation thereby providing long service life with a low degree of maintenance,
6. wide range of turndown capabilities with accurate control of the products of combustion.

Gas burners may be classified into three types, depending on the method of mixing the gaseous fuel and air.

The simplest arrangement, often called a throat-mix burner, consists of admitting the gas and air into the combustion chamber through separate ports, usually adjacent to each other, and allowing the two gasses to mix and burn in the furnace. This method of burning gas gives large, relatively slow-moving flames and has been widely used in firing open hearth steel furnaces.

A second type of mixing is found in the inspirator type of burner wherein the fuel gas is delivered to the burner under pressure and is discharged from a nozzle or jet in such a way that its momentum is used in mixing the gas with indrawn air.

The third type of burner involves premixing all or part of the air with the gas prior to delivery to the burner. With this arrangement the burner itself may be a relatively simple nozzle designed to deliver the combustible mixture without backfire or flame blowoff. A variety of arrangements are used for premixing and are well known in the art.

With any of these types of burners, the rate of gaseous combustion is markedly increased at hot surfaces. This effect is utilized in tunnel-port burners, in which the burner port or combustion chamber is made from a highly refractory tile and is so arranged that the tile port is heated to incandescence. Under some circumstances, however, this arrangement is disadvantageous as it produces local overheating and rapid erosion of the refractories.

Refractory-tunnel type burners are generally known in the art for use when the fuel and air are mixed within the burner itself. However in order to further accelerate the combustion process and provide high temperatures, it is often desirable to also use a premixture of fuel and air. The resulting severe service conditions leads to certain difficulties in obtaining the above-mentioned desired characteristics.

The above and other characteristics, advantages, and objects are achieved through the present invention as will be readily apparent from the following description.

SUMMARY OF THE INVENTION

This invention provides a premix natural gas burner with novel design characteristics and features that mark an improvement over previous designs. These characteristics are such that the burner is suitable for use in the rough atmosphere of a metal melting furnace while giving long service life with a low degree of maintenance.

One improvement is the inclusion of an access tunnel coming through the burner nose plug and extending to a point outside the burner body and capped with a standard burner peep sight which allows visual inspection of the interior of the combustion chamber and the furnace. This access tunnel is sized to allow entrance of both ram rods and oxygen lances should the burner become blocked with metal from the furnace. The tunnel is supported by a web that allows free passage of the air/gas mixture.

Another improvement is a dual composition refractory block for the combustion chamber preferably matched to the refractories used in the furnace lining. The portion of the combustion chamber in contact with the interior of the furnace is preferably made from a very wear resistant refractory similar to the interior furnace lining, such as silicon carbide or a high alumina refractory, while the portion adjoining the burner body is made from a low thermal conductivity refractory to prevent heat conduction problems and to allow cooler operation of the burner body. At the same time, the coefficients of thermal expansion of each portion should be compatible with each other and with the furnace refractories.

The end of the combustion chamber in communication with the furnace interior may advantageously be provided with a restriction, such as an opening of lesser diameter than the majority of the combustion chamber. This restriction insures that complete combustion occurs within the combustion chamber so that little or no uncombusted air exits the burner into the furance.

The composit refractory structure of the tunnel is a significant feature of this invention in that it provides a proper balance of the desired refractory properties which are not obtainable in a single refractory.

These improvements do not detract from the well known capability for a high turndown ratio inherent in premix burners containing nose plugs.

DESCRIPTION OF THE PREFERRED EMBODIMENT

Figure 1:
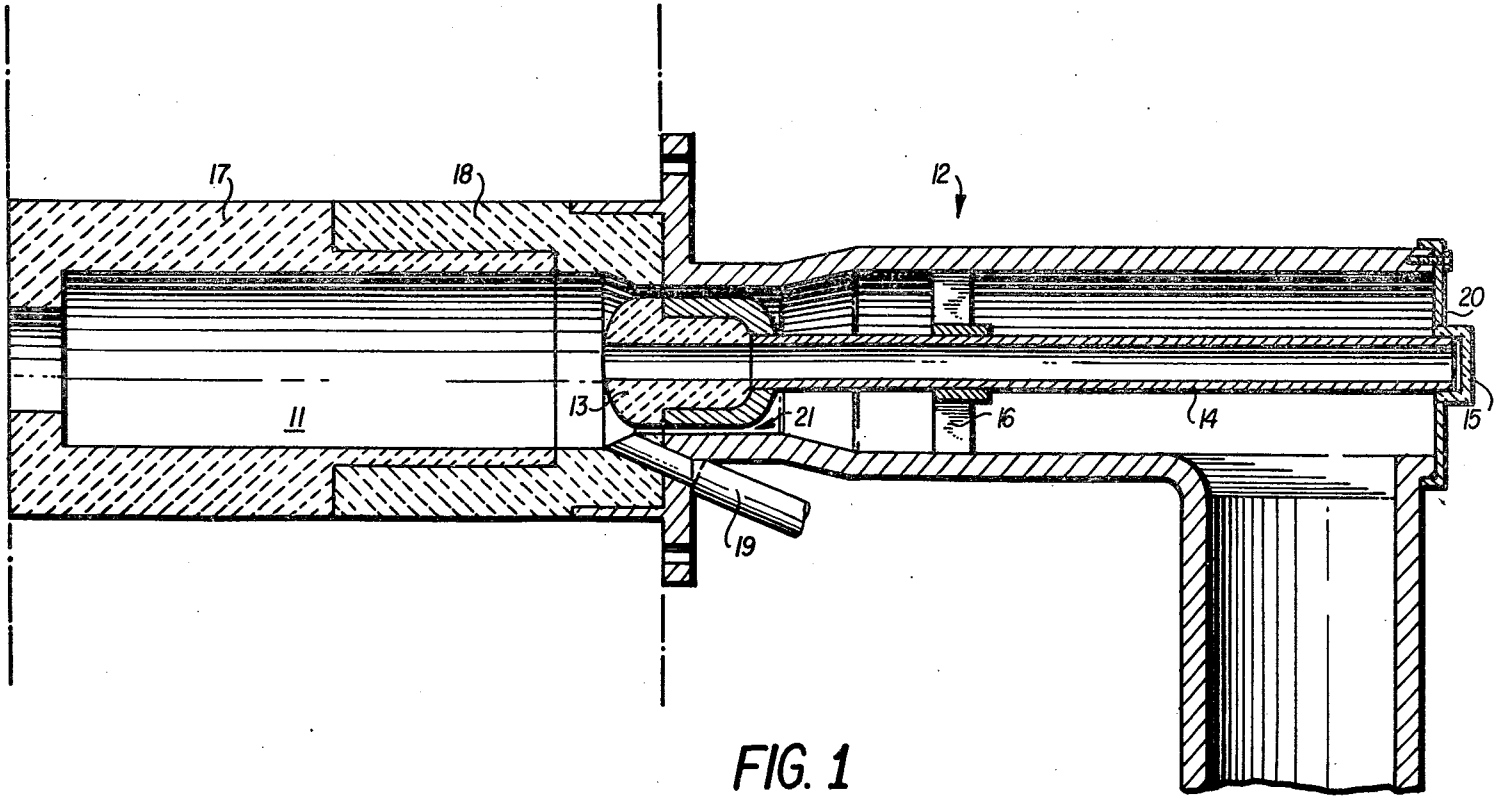
FIG. 1 is a vertical sectional view through a premix burner embodying the principles of this invention.

Referring now to the drawing, a burner assembly which incorporates the principles of this invention is shown generally in FIG. 1. The assembly comprises a combustion chamber 11, made of at least two types of refractory, which is adapted to fit into the wall of a melting furnace (not shown). The portion 17 of the combustion chamber nearest the interior of the furnace is made from an abrasion resistant refractory similar to the interior lining of the furnace, preferably silicon carbide. The portion 18 of the combustion chamber attached to the burner body 12 is preferably made from a castable refractory which has a low thermal conductivity and a coefficient of thermal expansion compatable with the first portion 17. This two part construction allows the combustion chamber to expand and contract with the furnace lining during thermal cycling while keeping the burner body insulated from much of the heat of the furnace. The flow of gas also helps to cool the burner body, preventing rapid deterioration due to overheating.

The burner body 12 is a tubular section open at two opposite ends; one of its open ends being attached to the combustion chamber 11, the other open end being attached to an air and fuel supply main (not shown). The burner body contains a bend section so that the combustion chamber is angularly disposed to the air and fuel supply main and is attached to the supply mains by any well known means such as welding, or flanging, or the like.

Within burner body 12 is a nose plug 13 for regulating the flow of air and fuel into the combustion chamber through restrictive passageway 21. Attached through the nose plug is a hollow access tube 14, slideably supported by a web 16 in the burner body, which is in communication with the exterior of the burner body. The exterior end of this access tube is removably capped with a transparent eye piece 15 which allows visual inspection of both the interior of the combustion chamber and even into the furnace itself. This access tube is sized to allow entrance of ram rods or lances to clear any blockage of the burner that may develop during use.

The burner body may also advantageously contain a removably attached flanged portion 20 in line with, and sized to permit removal of, the nose plug and its supporting web for repair or replacement of the nose plug without complete disassembly of the burner.

The burner body may also contain numerous other details common to burners of this type, one example is passageway 19 into the combustion chamber for ignition means such as direct spark plug ignition, premix pilot, or even manual ignition.

The premix burner of this invention is designed to operate primarily on natural gas mixed with air, but it can be adapted for use with other fuels such as propane, manufactured gas (synthetic gas), or even vaporized fuel oils.

It is advantageous that the flow rate of the uncombusted premixture be relatively low in the burner body so as to avoid excessive noise generation. This can be accomplished by either providing a large diameter burner body or by supplying the premixture at a high pressure. The velocity is increased just prior to combustion by flowing through restricted passageway 21.

The burner can be operated over a wide range of air and fuel flows giving good control to the composition of the products of combustion which exit the combustion chamber. This is especially important in many processes, such as metal melting where excess fuel is desired so as to prevent uncombused oxygen from reacting with the metal in the furnace, or other applications where fuel efficiency and controlled atmosphere conditions are to be satisfied simultaneously.

The form of the invention here described and illustrated are presented merely as examples of how the invention may be applied and are not intended to limit the invention since obvious modifications will be apparent to one skilled in the art.

What is claimed is:

1. The method of operating a furnace with a premix gas burner of the type having a combustion chamber with first and second refractory walls for effecting combustion of a gaseous premixture of fuel and air; a curved burner body having an intake end for receiving a gaseous premixture of fuel and air during use of the premix gas burner and a discharge end connected to the upstream end of said combustion chamber for delivering thereto the gaseous premixture; regulating means including a nose plug movably disposed within the burner body discharge end for regulating the flow of the gaseous premixture from said burner body into said combustion chamber; and means connected to said nose plug including a sealed access tube and extending coaxially through both said burner body and nose plug for enabling visual viewing of the interior of said combustion chamber and being of sufficient size to enable insertion therethrough a means for cleaning to the interior of said combustion chamber without disconnection of said burner body therefrom; comprising the steps of:

(a) introducing said premixture at a low velocity into a curved burner body;

(b) flowing said premixture through said curved body around the exterior of a sealed access tube, thereby cooling said tube;

(c) regulating the flow of said premixture from said burner body into a combustion chamber by positioning said nose plug in the flow path;

(d) igniting and combusting said premixture in said combustion chamber having a low heat conducting first refractory wall and an abrasion resistant second refractory wall;

(e) passing the combusted gasses out of said combustion chamber at a high temperature through an opening in said second abrasion resistant refractory wall and into said furnace.

2. The method of claim 1 wherein step (a) includes adjusting the composition of said premixture so that there is more fuel supplied than theoretically needed to react with all the air present, and step (d) includes combusting essentially all of the air in the premixture so that the combusted gases of step (e) contain no uncombusted air.

3. The method of claim 1 wherein step (c) includes forming a restricted passageway between said nose plug and said burner body and preventing any flame from propagating into the burner body from the combustion chamber by sizing said passageway so that the forward velocity of the premixture exceeds the rearward velocity of flame propagation.

4. The method of claim 1 further including the step of inserting a means for cleaning through said access tube and nose plug to remove any blockage of the combustion chamber exit which occurs during operation of the furnace, said step being performed without extinguishing the combustion process.

5. The method of claim 1 further including the steps of stopping the flow of gas fuel thereby extinguishing combustion, then sliding said nose plug and access tube out and away from said burner body, through a removable end flange, for repair, said steps being performed while said burner body and combustion chamber remain attached to the furnace.

* * * * *